US005848745A

United States Patent [19]

Hillebrand

[11] Patent Number: 5,848,745

[45] Date of Patent: Dec. 15, 1998

[54] STITCHING DEVICE

[75] Inventor: Bernd Anton Hillebrand, Bergrheinfeld, Germany

[73] Assignee: Koenig & Bauer-Albert Aktiengesellschaft, Wurzburg, Germany

[21] Appl. No.: 945,275

[22] PCT Filed: May 13, 1996

[86] PCT No.: PCT/DE96/00829

§ 371 Date: Nov. 20, 1997

§ 102(e) Date: Nov. 20, 1997

[87] PCT Pub. No.: WO96/36492

PCT Pub. Date: Nov. 21, 1996

[30] Foreign Application Priority Data

May 20, 1995 [DE] Germany ..... 195 18 653.2

[51] Int. Cl.[6] ..... B42B 4/02; B41F 13/66

[52] U.S. Cl. ..... 227/81; 270/53

[58] Field of Search ..... 227/81, 82, 83, 227/84; 270/53, 54, 55, 56, 57, 58

[56] References Cited

U.S. PATENT DOCUMENTS

| | | | |
|---|---|---|---|
| 2,717,383 | 9/1955 | Stobb . | |
| 4,204,627 | 5/1980 | Kutzner . | |
| 5,172,897 | 12/1992 | Hansch et al. . | |
| 5,284,466 | 2/1994 | Magnusson et al. . | |
| 5,356,125 | 10/1994 | Hansch et al. . | |
| 5,464,199 | 11/1995 | Stauber . | |
| 5,570,832 | 11/1996 | Meier | 227/81 |
| 5,590,828 | 1/1997 | Stauber | 227/81 |
| 5,772,097 | 6/1998 | Hillebrand | 227/81 |

FOREIGN PATENT DOCUMENTS

| | | |
|---|---|---|
| 0 476 718 | 3/1992 | European Pat. Off. . |
| 0 520 967 | 12/1992 | European Pat. Off. . |
| 0 606 555 | 7/1994 | European Pat. Off. . |
| 2 411 072 | 7/1979 | France . |
| 1 894 733 | 6/1964 | Germany . |
| 1 955 351 | 1/1972 | Germany . |
| 25 27 094 | 1/1976 | Germany . |
| 29 32 757 | 3/1982 | Germany . |

*Primary Examiner*—Scott A. Smith
*Attorney, Agent, or Firm*—Jones, Tullar & Cooper, P.C.

[57] ABSTRACT

A stapling device is usable to staple printed products transversely to their direction of travel in a folding machine of a rotary press assembly. There is no relative movement between the stapling heads and the product sections during stapling. The stapling heads move directly radially to the counter cylinder during the stapling operation.

2 Claims, 3 Drawing Sheets

STITCHING DEVICE

FIELD OF THE INVENTION

The invention relates to a stapling device for transverse stapling of product elements, in particular in a folding apparatus downstream of a rotary printing press.

Description of the Prior Art

DE 29 32 757 C2 describes a stapling device in a folding apparatus of a rotary printing press. In this case a combined cutting and stapling cylinder is provided with female and male molds, which shape staples. The male mold is moved by means of a four-bar link.

It is disadvantageous in connection with this stapling device that during the stapling process the staple performs a relative movement in the circumferential direction in relation to the collecting cylinder and the product elements. This can result in damage of the products and pulled-out stapled connection.

EP 06 06 555 A1 describes a rotating stapling apparatus with stapling heads arranged in a star shape. These stapling heads are pivotable and work together with supports fixed in place on a collecting drum. It is disadvantageous here that the stapling heads perform a back-and-forth movement, so that large acceleration forces are required.

A stapling device is known from U.S. Pat. No. 2,727,383. In this device, a stapling head, which is capable of swinging back-and-forth, cooperates with a counter support fixed on the cylinder.

EP 05 20 967 A1 discloses a stapling device wherein the stapling heads, as well as the counter supports, are respectively rotatingly arranged on separate cylinders. It is disadvantageous here that the counter support is rotatingly arranged on a cylinder.

SUMMARY OF THE INVENTION

It is the object of the invention to provide a stapling device for transverse stapling of product elements, wherein in the course of a stapling process a staple does not perform a relative movement in the circumferential direction in respect to the product elements to be stapled or respectively to a counter cylinder.

In accordance with the invention, a stapling cylinder is provided with stapling heads which are arranged to work with a counter cylinder that is provided with staple closure beds. The stapling heads point in the direction of the axis of rotation of the counter cylinder during the stapling process. The stapling cylinder or cylinders are disposed on a rotating stapling cylinder support. The speed of rotation of the stapling cylinder approximately corresponds to a sum of the rotational speed of the stapling cylinder support plus the rotational speed of the counter cylinder.

The advantages which can be attained by means of the invention primarily consist in that relative movements of the staples vertically in respect to the stapling movement in relation to the product elements or respectively to the opposed closure beds are avoided to a large degree. By means of this bending stresses acting on the staples and the opposed closure beds are reduced. This stapling movement generates a great stapling quality, since the tearing of the staple out of the product elements is prevented. By means of the optimized stapling movement it is possible to staple product elements which, in comparison to the prior art, are thicker, or respectively more layers of product elements, as well as to achieve higher production speeds. Furthermore, the load acting on the stapling device because of vibrations is reduced.

BRIEF DESCRIPTION OF THE DRAWINGS

The stapling device in accordance with the invention is represented in the drawing and will be described in more detail in what follows.

Shown are in.

DETAILED DESCRIPTION OF THE PREFERRED EMBODIMENT

Figure 1:
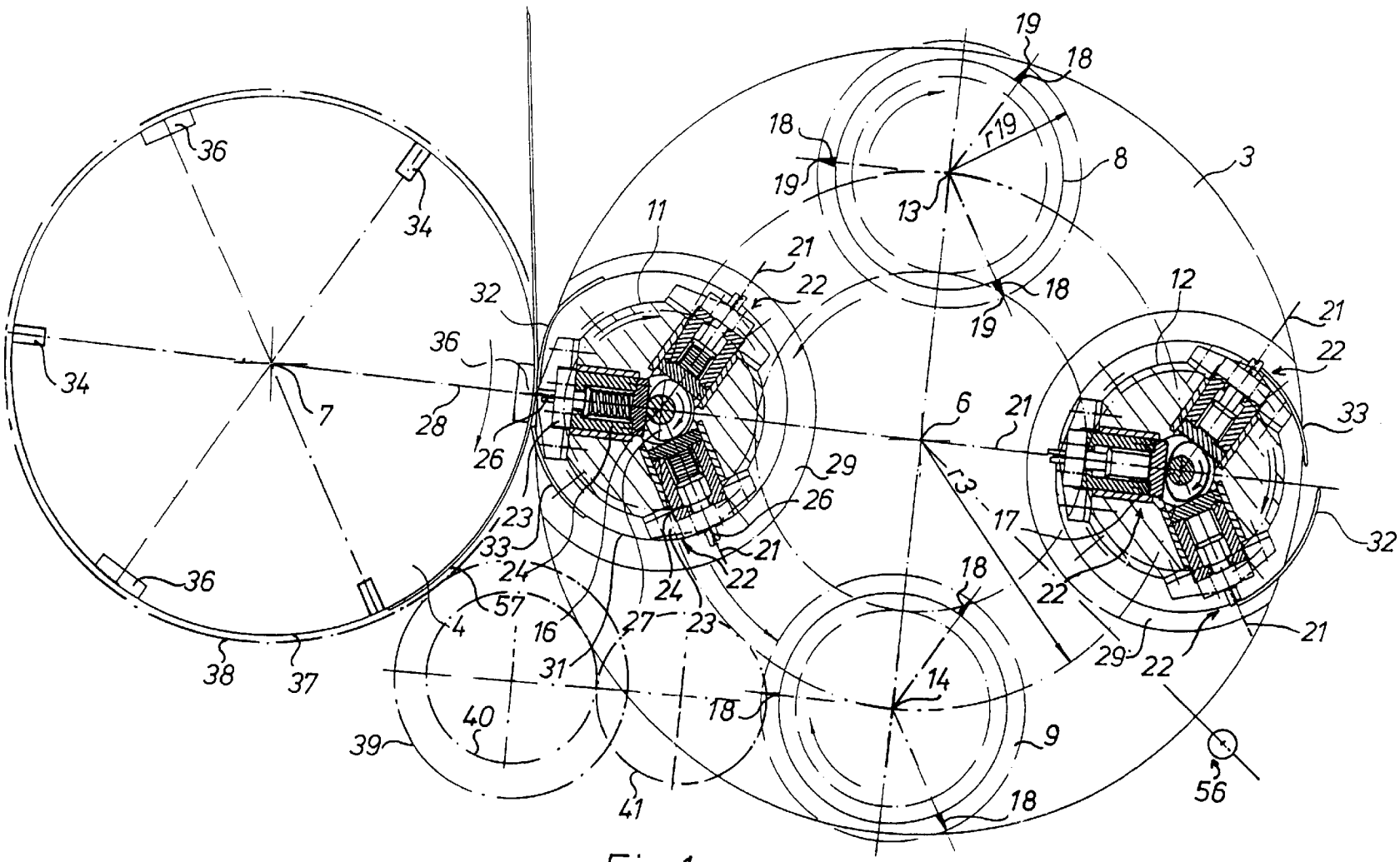
FIG. 1, a schematic lateral view of a stapling device in accordance with the invention.

In side frames 1, 2 of, for example a folding apparatus of a rotary printing press, a cutting and stapling cylinder support 3 and a collecting cylinder 4 acting as counter cylinder 4 are seated, rotatable in the same direction around their parallel extending axes of rotation 6, 7, as may be seen in FIG. 1. In the instant exemplary embodiment (FIGS. 1 to 3), the cutting and stapling cylinder support 3 is provided with two rotatable cutting cylinders 8, 9 as well as two rotatable stapling cylinders 11, 12, whose axes of rotation 13, 14, 16, 17 are arranged, offset in pairs by 180°, concentrically at a radius r3, for example r3=300 mm, in respect to the axis of rotation 6 of the cutting and stapling cylinder support 3. In this case the cutting and stapling cylinders 8, 9, 11, 12 are offset by 90° in respect to each other. In the course of a cutting or respectively stapling process the cutting and stapling cylinders 8, 9, 11, 12 turn in the opposite direction in respect to the collecting cylinder 4. Three cutters 18, extending parallel with the axes of rotation of the cutting cylinders 8, 9, are fastened in each of the latter and are offset by 120° in respect to each other, and their cutting edges 19 are arranged at a radius r19, for example r19=150 mm, concentrically in respect to the axis of rotation 13, 14 of the respective cutting cylinder 89. The stapling cylinders 11, 12 are constructed in the same way, therefore the following description is restricted to one stapling cylinder 11. Three staple levels 21, respectively offset by 120° and extending parallel with the axes of rotation 16 of the stapling cylinder 11 are provided in the latter, in which a plurality of stapling heads 22, in the instant example two, are fastened in the axial direction.

Essentially each stapling head 22 consists of a die 23, fixed in place in respect to the stapling cylinder 11, 12, and a spring-loaded radially movable stapling piston 24. On their outward pointing end, the stapling pistons 24 are provided with two cutting and guide elements 26. A camshaft 27 acts on an inwardly oriented end of the stapling piston 24. This camshaft 27 is seated in the center of the stapling cylinder 11 and rotates at rpm of n27, which exactly corresponds to rpm n3 or a whole-number multiple of the rpm n3 of the cutting and stapling cylinder support 3. The camshaft 27 is designed in such a way that while the stapling wire is transferred, the stapling piston 24 is extended and, following the completed stapling, i.e. in a center line 28 of the cutting and stapling cylinder 3 and collecting cylinder 4, is completely retracted. A bending horn 29, for example an eccentric one, is respectively arranged around the stapling cylinders 11, 12 in the interior of the cutting and stapling cylinder support 3 in the area of the stapling heads 22. A distance of the interior surface 31 of the bending horn, extending parallel with the axis of rotation 16 of the stapling cylinder 11, to the axis of rotation 16 of the stapling cylinder 11 is reduced in the direction of rotation of the stapling cylinder 11, for example by means of an eccentric arrangement of the hollow cylinder-shaped, segment of a circle-shaped bending horn 29, or an interior surface 31 of the bending horn embodied in a helical shape. The bending horn 29 is continued at each end outside of the jacket surface of the cutting and stapling cylinder support 3 in the form of two resilient sheet metal pieces 32, 33. These resilient sheet metal pieces 32, 33 leave only a narrow gap between their facing ends.

The collecting cylinder 4 is used as the counter cylinder for the cutting and stapling cylinders 8, 9, 11, 12 and therefore is provided with cutter bars 34 fixed in place on the cylinder and opposed closure beds 36 fixed in place on the cylinder. Respectively three cutter bars 34 and opposed closure beds 36, offset by 120°, have been cut, congruently with a jacket surface 37 of the collecting cylinder 4 with a radius r4, for example r4=300 mm, concentrically in respect to the axis of rotation 7 of the collecting cylinder 4, wherein the cutter bars 34 and the opposed closure beds 36 are offset by 60° in respect to each other.

Figure 2:
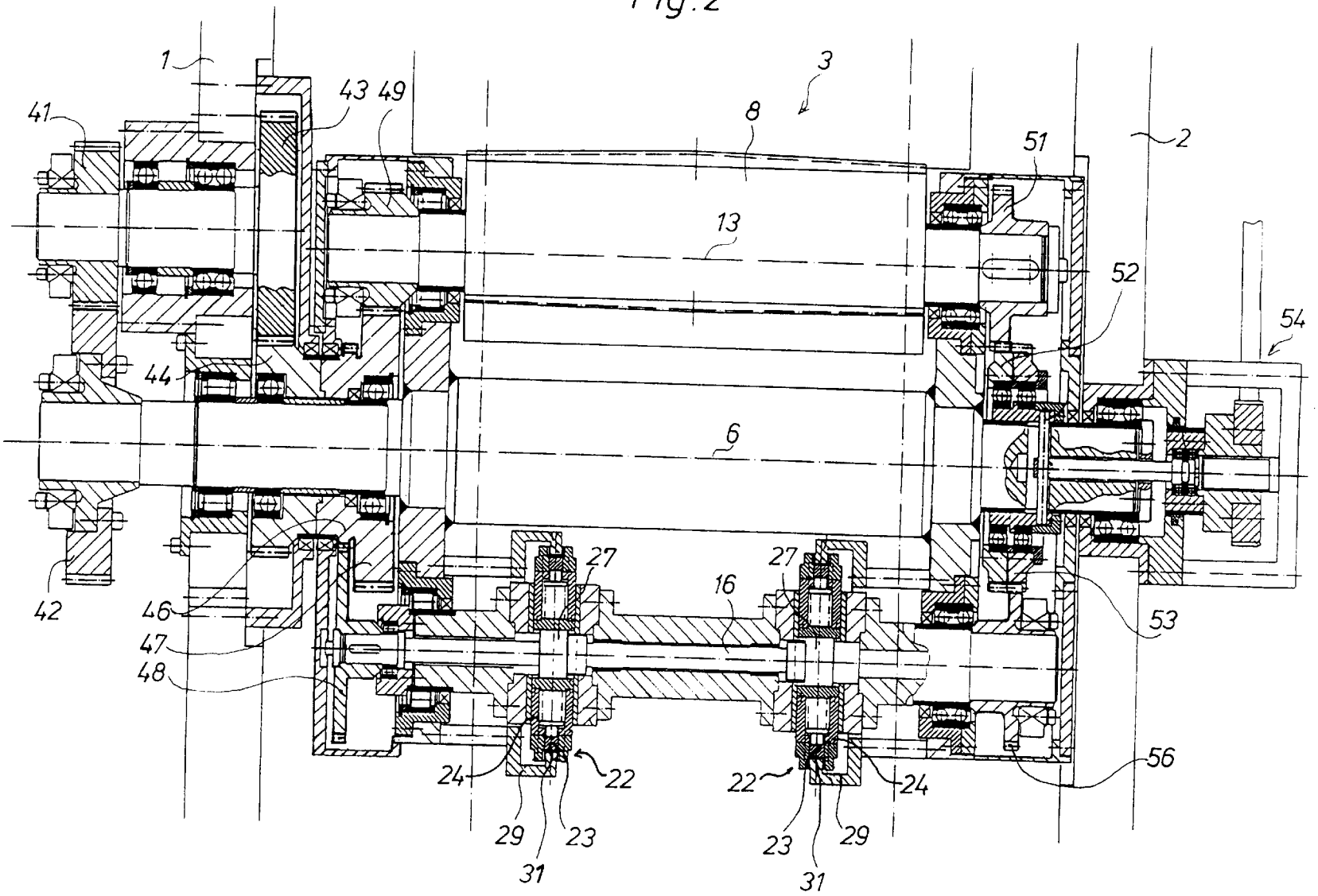
FIG. 2, a schematic sectional view of the stapling device in accordance with the invention.

The drive of the cutting cylinders 8, 9 and stapling cylinders 11, 12, as shown most clearly in FIG.2, is performed by means of a planetary toothed gear, starting at a main drive toothed gear train. To this end the collecting cylinder 4 has a toothed wheel 38 with a number of teeth z38, for example z38=132, which is driven by a drive, not represented. For driving the cutting and stapling cylinder support 3, an intermediate toothed wheel 39 with a number of teeth z39, for example z39=64, which is seated in the side frame 1, engages this toothed wheel 38 of the collecting cylinder 4, and in turn cooperates, by means of an intermediate toothed wheel 40, with a second intermediate toothed wheel 41 with a number of teeth z41, for example z41=64, which is seated in the side frame 1. This second intermediate toothed wheel 41 meshes with a toothed wheel 42 with a number of teeth z42, for example z42=88, of the cutting and stapling cylinder support 3, so that the cutting and stapling cylinder support 3 rotates at n3 rpm.

A toothed wheel 43 with a number of teeth z43, for example z43=39, is connected with the intermediate toothed wheel 41 and engages a toothed wheel 44 with a number of teeth z44, for example z44=33, which is seated freely rotatable concentrically in respect to the axis of rotation 6 of the cutting and stapling cylinder support 3. Two sun wheels 46, 47 with teeth on the exterior and with a number of teeth z46, for example z46=72 or respectively z47, for example z47=96, are connected with this toothed wheel 44. A planetary toothed wheel 48 with a number of teeth z48, for example z48=60, of the camshaft 27 of the respective stapling cylinder 11, 12 meshes with the first toothed sun wheel 46, and a planetary toothed wheel 49 with a number of teeth n49, for example n49=36, of the respective cutting cylinder 8, 9 meshes with the second toothed sun wheel 47.

On the opposite side of the cutting cylinders 8, 9 a second, obliquely-toothed planetary toothed wheel with a number of teeth z51, for example z51=52, is fastened on the cutting cylinder 8, which engages a freely rotatable toothed sun wheel 52, also obliquely-toothed, with a number of teeth z52, for example z52=78, which is concentrically seated in respect to the axis of rotation 6 of the cutting and stapling cylinder support 3. This toothed sun wheel 52 is rigidly connected with a second, obliquely-toothed sun wheel 53 with a number of teeth z53, for example z53=78, and both toothed sun wheels 52, 53 are together axially displaceable by means of an actuator drive 54. The second toothed sun wheel 53 meshes with a toothed planetary wheel 56 with a number of teeth z56, for example z56=52, of the respective stapling cylinder 11, 12, so that the stapling cylinder 11, 12 rotates at n11 rpm. The oblique surfaces of the teeth of the toothed sun or planetary wheel 52, 51 of the cutting cylinders 8, 9 are unequal to the oblique surfaces of the teeth of the toothed sun or planetary wheel 53, 54 of the stapling cylinder 11, 12, because of which a phase shift between the cutting cylinders 8, 9 and the stapling cylinders 11, 12 can be performed. By means of this the stapling can be matched to a lower or upper fold.

The cutter bars 34 or respectively the opposed closure beds 36 of the collecting cylinder 4 work together with the cutters 18 of the two cutting cylinders 8, 9 or respectively the stapling heads 22 of the two stapling cylinder 11, 12. For this reason the rpm n3 of the cutting and fastening cylinder support 3 must be 1.5 times the rpm n4 of the collecting cylinder 4, i.e. n3=1.5×n4. In order to achieve an approximately radial orientation of the cutters 18 or respectively the stapling heads 22 in respect to the collecting cylinder 4 during cutting or respectively stapling, the rpm n8 of the cutting cylinders 8, 9 or respectively an rpm n11 of the stapling cylinders 11, 12 is a sum of the amount of the rpm n3 of the cutting and stapling cylinder support 3 and the amount of the rpm n4 of the collecting cylinder 4, i.e. n8=|n3|+|n4|, or respectively n11=|n3|+|n4|. With the mentioned radii r3, r4 an approximately equal circumferential speed of the cutters 18 or respectively the stapling heads 22 and the cutter bars 34 or respectively the opposed closure beds 36 during cutting results.

A staple wire feeding device 56, not shown in detail, is disposed, offset by 144° in the direction of rotation of the cutting and stapling cylinder support 3 in respect to the center line 28 of the cutting and stapling cylinder support 3 and the collecting cylinder 4, at the periphery of the cutting and stapling cylinder support 3. At this location, the stapling head 22 performing the next stapling is at its greatest distance from the axis of rotation 6 of the cutting and stapling cylinder support 3, i.e. the stapling head 22, the axis of rotation 16, 17 of the stapling cylinders 11, 12 and the axis of rotation 6 of the cutting and stapling cylinder support 3 are located on a common straight line. A high section of the camshaft 27 presses the cutting and guiding elements 26 against a spring force sufficiently far outside, that the corresponding, maximally occurring radius of the cutters 18 is exceeded. In this way a U-shaped female die for bending the staple is formed by means of the fixed die 23 and the extended cutting and guide elements 26. A stapling wire is fed to the cutting and guide elements 26 of the stapling head 22 and is subsequently cut off by the continuing rotating movement of the cutting and stapling cylinder support 3. Immediately following the completed cut, the cut-off wire is brought underneath the first—viewed in the direction of rotation —resilient sheet metal piece 32 by the continuing rotating movement of the stapling cylinders 11, 12. In this way the stapling wire is fixed in the cutting and guide elements 26. The stapling wire is conducted into the area of the bending horn 29 by the continuing rotating movement of the stapling cylinders 11, 12 with the stapling heads 22. Because of the decreasing distance of the inner surface 31 of the bending horn 29 in respect to the axis of rotation 16 of the stapling cylinder 11, the stapling wire is pushed into the U-shaped female die formed by the die 23 and the cutting and guide elements 26 and is therefore shaped into a staple during the rotating movement of the stapling cylinder 11. The shaping of the staple is terminated at the latest prior to the exit out of the bending horn 29, in the instant example approximately after a 180° rotating movement of the stapling head 22 in the bending horn 29. At least until this time the high area of the camshaft 27 presses the stapling piston 24 with the cutting and guide elements 26 outward. Thereafter the formed staple is held by the second resilient sheet metal piece 33, which continues the bending horn 29 in the direction of rotation. The camshaft 27 rotates from its high into its low area in relation to the stapling piston 24. In the process the stapling piston 24 with the cutting and guide elements 26 moves radially inward and partially releases the staple legs of the staple. At the latest shortly prior to the contact of the staple legs with the product elements 57, the respective stapling heads 22—and therefore also the staples—extend radially in respect to the axis of rotation 7 of the collecting cylinder 4. The entire stapling movement is performed by the superimposed radially rotating movements of the stapling cylinder 11, 12 and the cutting and stapling cylinder support 3 in respect to the axis of rotation 7 of the collecting cylinder 4. By means of the rotating movement of the cutting and stapling cylinder support 3, the staple is pushed into the product elements 57 by the fixed dies 23, which act on the back of the staple. As soon as the staple is moved by the product elements 57, the cutting and guide elements 26 are completely retracted and the staple leaves the second resilient sheet metal piece 33. The staple penetrates the product elements 57 and is closed by the opposed closure beds 36 which are provided, for example, with oat grain-like depressions.

Figure 3:
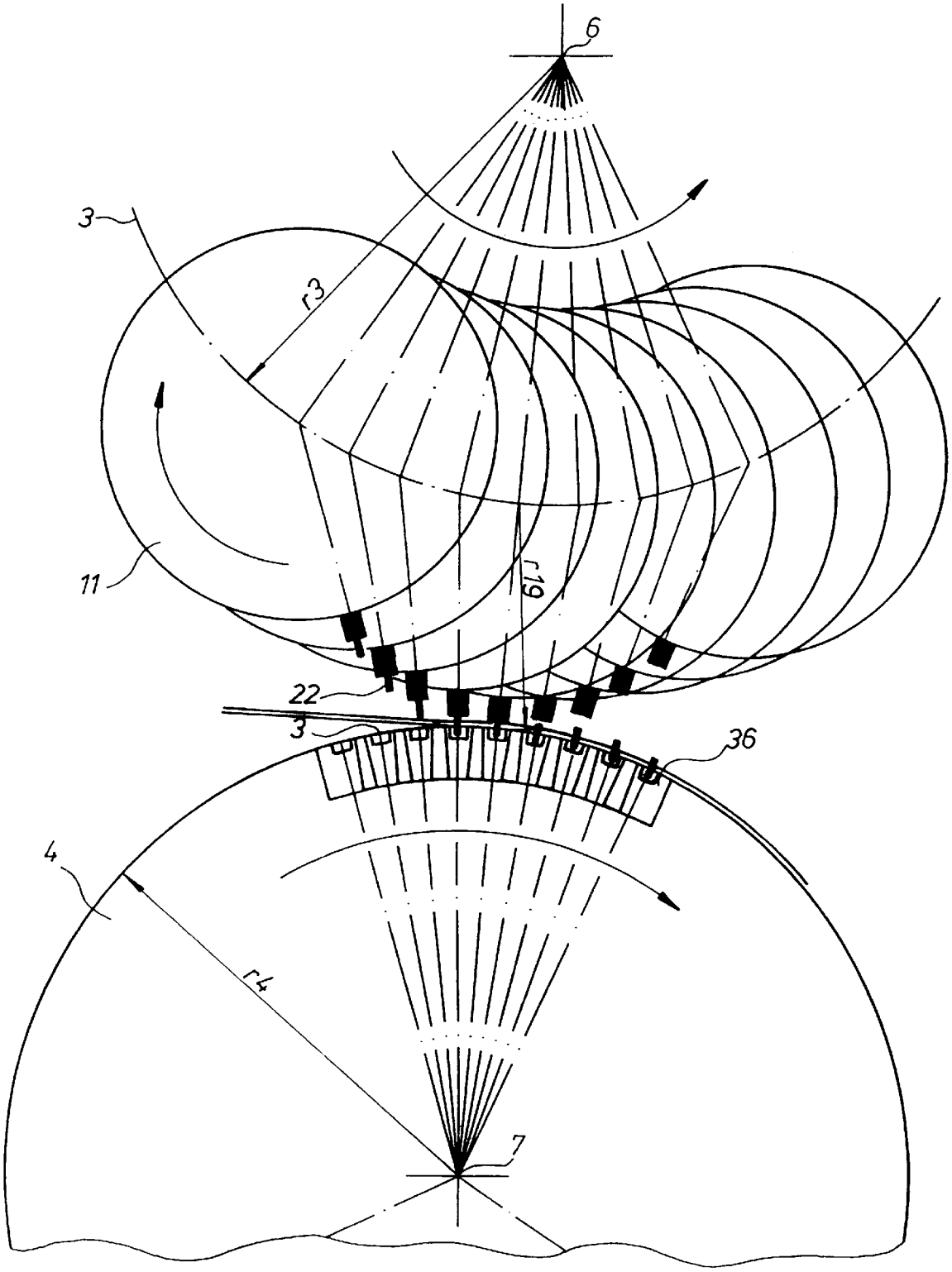
FIG. 3, a schematic representation of an enlarged portion of a movement progression in the course of a stapling process in accordance with FIG. 1.

To perform the described stapling process, the stapling cylinders 11, 12 and therefore the stapling heads 22 rotate around their respective axes of rotation 16, 17. This rotating movement is performed by means of the described drive in such a way that the respective staple head 22, which participates in the actual stapling process, performs an approximately radial rotating movement oriented to the axis of rotation 7 of the collecting cylinder 4 at least from the start to the finish of the stapling process, i.e. from the contact on the product elements 57 to lifting off the product elements 57, as is depicted in FIG. 3. In the process, the participating stapling heads 22 as well as the corresponding opposed closure beds 36 move at the approximate speed of the web.

In place of the described planetary gear, other drives can also be employed for performing the rotating movement of the cutting and stapling cylinders 8, 9, 11, 12. It is conceivable, for example, to rotate the cutting and stapling cylinders 8, 9, 11, 12 directly by means of electric or hydraulic motors synchronized with the cutting and stapling cylinder support 3.

The stapling cylinder 11 can, of course, also be seated in its own, rotating stapling cylinder support separated from the cutting cylinders 8, 9.

The device in accordance with the invention is not limited to the represented exemplary embodiment with a three-part collection cylinder 4, but can also be adapted to other cutting and stapling devices with, for example, five- or seven-part collecting cylinders.

While a preferred embodiment of a stitching device in accordance with the present invention has been set forth fully and completely hereinabove, it will be apparent to one of skill in the art that a number of changes in, for example, the type of printing press, the type of product web being printed, the overall structure of the folding device, and the like could be made without departing from the true spirit and scope of the present invention, which is accordingly to be limited only by the following claims.

What is claimed is:

1. A stapling device usable to transversely staple product elements in a folding apparatus portion of a rotary printing press assembly, said stapling device comprising:

a stapling cylinder;

a plurality of stapling heads on said stapling cylinder;

a counter cylinder having staple closure beds, said staple closure beds being arranged to cooperate with said stapling heads, said counter cylinder having an axis of rotation and being rotatable at a counter cylinder speed of rotation, each said stapling head pointing toward said counter cylinder axis of rotation during stapling of the product elements;

a stapling cylinder support having a stapling cylinder support axis of rotation and being rotatable at a stapling cylinder support speed of rotation; and means for supporting said stapling cylinder on said stapling cylinder support for rotation about a stapling cylinder axis of rotation and for rotating said stapling cylinder at a stapling cylinder speed of rotation, said stapling cylinder speed of rotation corresponding to a sum of said counter cylinder speed of rotation plus said stapling cylinder support speed of rotation.

2. The stapling device of claim 1 wherein said means for rotating said stapling cylinder includes a planetary toothed gear wheel.

* * * * *